US011253737B2

(12) United States Patent
Shields et al.

(10) Patent No.: US 11,253,737 B2
(45) Date of Patent: Feb. 22, 2022

(54) SPRINKLER ASSEMBLY WITH LEVERS

(71) Applicant: Tyco Fire Products LP, Lansdale, PA (US)

(72) Inventors: Steven Lee Shields, Lubbock, TX (US); Manuel R. Silva, Jr., Cranston, RI (US)

(73) Assignee: Tyco Fire Products LP, Lansdale, PA (US)

( * ) Notice: Subject to any disclaimer, the term of this patent is extended or adjusted under 35 U.S.C. 154(b) by 151 days.

(21) Appl. No.: 16/589,754

(22) Filed: Oct. 1, 2019

(65) Prior Publication Data

US 2020/0101339 A1 Apr. 2, 2020

Related U.S. Application Data

(60) Provisional application No. 62/740,268, filed on Oct. 2, 2018, provisional application No. 62/740,243, filed on Oct. 2, 2018, provisional application No. 62/740,247, filed on Oct. 2, 2018.

(51) Int. Cl.

| | |
|---|---|
| ***A62C 37/12*** | (2006.01) |
| ***B05B 1/30*** | (2006.01) |
| ***A62C 35/68*** | (2006.01) |
| ***B05B 3/04*** | (2006.01) |
| ***A62C 37/08*** | (2006.01) |

(52) U.S. Cl.

CPC ..... *A62C 37/08* (2013.01); *A62C 35/68* (2013.01); *A62C 37/12* (2013.01); *B05B 1/30* (2013.01); *B05B 3/0486* (2013.01)

(58) Field of Classification Search

CPC ..... A62C 35/68; A62C 37/08; A62C 37/11; A62C 37/12; A62C 37/16; B05B 1/30; B05B 3/0486

USPC ..... 169/40

See application file for complete search history.

(56) References Cited

U.S. PATENT DOCUMENTS

| | | | | |
|---|---|---|---|---|
| 3,010,521 | A * | 11/1961 | Seaberg | A62C 37/10 169/40 |
| 3,061,016 | A * | 10/1962 | Hodgman, Jr. | A62C 37/12 169/42 |
| 6,840,329 | B2 | 1/2005 | Kikuchi et al. | |
| 6,962,208 | B2 * | 11/2005 | Franson | A62C 37/09 169/16 |
| 7,275,603 | B2 | 10/2007 | Polan | |
| 2004/0134670 | A1 | 7/2004 | Orr et al. | |
| 2013/0014963 | A1 | 1/2013 | Porta | |
| 2013/0306334 | A1 | 11/2013 | Koiwa | |

(Continued)

*Primary Examiner* — Darren W Gorman
(74) *Attorney, Agent, or Firm* — Foley & Lardner LLP

(57) ABSTRACT

A sprinkler includes a body defining (a) a passage having an inlet and extending along a longitudinal axis and (b) an outlet fluidly coupled to the passage. The sprinkler includes a seal engaging a button and the body to fluidly seal the inlet from the outlet. A link and lever assembly includes a first lever and a second lever engaging the button. The first lever and the second lever each include (a) a leg positioned near a base end of the lever and extending outward from the longitudinal axis, the leg defining an engagement surface, (b) a head positioned near a tip end of the lever, and (c) a main body extending from the leg to the head. A fusible link limits movement of the heads. The engagement surfaces each engage a surface of the body to limit movement of the button along the longitudinal axis.

17 Claims, 18 Drawing Sheets

(56) References Cited

U.S. PATENT DOCUMENTS

| | | | | |
|---|---|---|---|---|
| 2015/0083442 | A1 | 3/2015 | Koiwa | |
| 2016/0030785 | A1 | 2/2016 | Ringer et al. | |
| 2017/0319884 | A1* | 11/2017 | Oldham | B05B 1/267 |

* cited by examiner

SPRINKLER ASSEMBLY WITH LEVERS

CROSS-REFERENCE TO RELATED PATENT APPLICATIONS

This application claims the benefit of U.S. Provisional Patent Application Nos. 62/740,243, filed Oct. 2, 2018, 62/740,247, filed Oct. 2, 2018, and 62/740,268, filed Oct. 2, 2018. This application is related to (i) U.S. patent application Ser. No. 16/589,738, titled SPRINKLER ASSEMBLY WITH BUTTON), filed Oct. 1, 2019, and (ii) U.S. patent application Ser. No. 16/589,798, titled SPRINKLER ASSEMBLY WITH CAP AND COVER), filed Oct. 1, 2019, both of which are incorporated herein by reference in their entireties.

BACKGROUND

Fire suppression sprinkler systems are widely used for fire protection. These systems have sprinklers that are activated in response to an indication that a fire may be nearby (e.g., the ambient temperature in an environment, such as a room or building, exceeds a predetermined value). Once activated, the sprinklers distribute fire-extinguishing fluid, such as water, in the room or building.

SUMMARY

At least one embodiment relates to a sprinkler including a body defining (a) a passage having an inlet configured to be fluidly coupled to a source of fire suppressant fluid, the passage extending along a longitudinal axis, and (b) an outlet fluidly coupled to the passage. The sprinkler further includes a button positioned along the passage, a seal engaging the button and the body to fluidly seal the inlet from the outlet, and a link and lever assembly. The link and lever assembly includes a first lever and a second lever engaging the button and a fusible link. The first lever and the second lever each include (a) a leg positioned near a base end of the lever and extending outward from the longitudinal axis, the leg defining an engagement surface, (b) a head positioned near a tip end of the lever, and (c) a main body extending along the longitudinal axis from the leg to the head. The fusible link limits movement of the heads away from the longitudinal axis. The engagement surfaces each engage a surface of the body to limit movement of the button along the longitudinal axis.

Another embodiment relates to a sprinkler including a body a body defining (a) a passage having an inlet configured to be fluidly coupled to a source of fire suppressant fluid, the passage extending along a longitudinal axis, (b) an outlet fluidly coupled to the passage, and (c) a body engagement surface. The sprinkler further includes a button positioned along the passage and defining a button engagement surface, a seal engaging the button and the body to fluidly seal the inlet from the outlet, and an activation assembly holding the button against the seal. The activation assembly defines a first engagement surface engaging the button engagement surface and a second engagement surface engaging the body engagement surface. At least one of the body engagement surface, the button engagement surface, the first engagement surface, or the second engagement surface are angled relative to the longitudinal axis such that a rotation of the activation assembly about the longitudinal axis causes a longitudinal movement of at least one of the activation assembly or the button relative to the body.

Another embodiment relates to a method of manufacturing a sprinkler. The method includes providing a body defining a passage extending along a longitudinal axis between an inlet and an outlet, forming a link and lever assembly by coupling a pair of levers to one another using a fusible link, inserting a seal and a button into the passage until the seal engages a seat of the body, inserting the link and lever assembly into the body until a button engagement surface of the button engages a first engagement surface of the link and lever assembly, and rotating the link and lever assembly about the longitudinal axis until a second engagement surface of the link and lever assembly engages a body engagement surface of the body.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate the exemplary embodiments in detail, it should be understood that the present disclosure is not limited to the details or methodology set forth in the description or illustrated in the figures. It should also be understood that the terminology used herein is for the purpose of description only and should not be regarded as limiting.

Overview

Fire suppression sprinklers generally include a body with an outlet, an inlet connectable to a source of fire retardant fluid or fire suppressant fluid under pressure, and a deflector supported by the body in a position opposing the outlet for distribution of the fire-extinguishing fluid over a predetermined area to be protected from fire. Individual fire suppression sprinklers may be closed or sealed by a cap. The cap is held in place by a thermally-sensitive element which is released when its temperature is elevated to within a prescribed range, e.g. by the heat from a fire.

Figure 1:
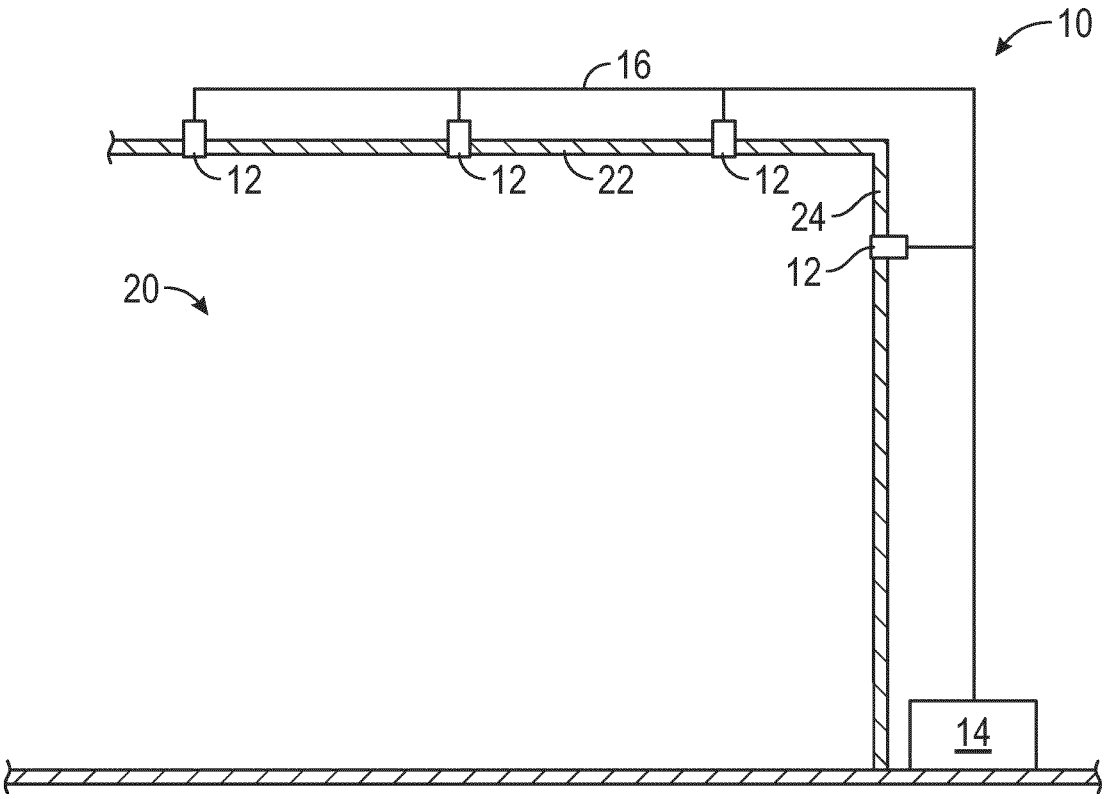
FIG. 1 is a schematic view of a fire suppression system of a building, according to an exemplary embodiment.

Referring to FIG. 1, a fire suppression system 10 of a building is shown according to an exemplary embodiment. The fire suppression system 10 includes a series of sprinklers 12 fluidly coupled to a source 14 of fire suppressant fluid, such as water. The source 14 can include a pump that pressurizes the fire suppressant fluid, a reservoir filled with fire suppressant fluid and positioned atop the building, or another source of pressurized fire suppressant fluid. The sprinklers 12 are fluidly coupled to the source 14 through one or more conduits 16 (e.g., pipes, hoses, etc.). A room 20 of the building can utilize one or more sprinklers 12. In some embodiments, the sprinklers 12 and/or the conduits 16 extend above a ceiling 22 of the room 20 such that the sprinklers 12 and/or the conduits 16 are obscured from view. Additionally or alternatively, the sprinklers 12 may extend into a wall 24 such that the sprinklers 12 and/or conduits 16 are obscured from view. In other embodiments, the sprinklers 12 and/or the conduits 16 are not obscured from view. In the event that a fire occurs within the room 20, the ambient temperature around the sprinklers 12 increases. Once the temperature increases above a threshold temperature, the sprinklers 12 activate, spreading the fire suppressant fluid throughout the room 20 to contain and/or extinguish the fire.

Some fire sprinklers include components made primarily from metal, such as brass. To reduce manufacturing cost, such sprinklers include many relatively simple parts that can be easily produced using common metal forming techniques (e.g., casting, drilling, tapping, stamping, etc.). These components are then assembled together to form the sprinkler assembly.

Figure 2:
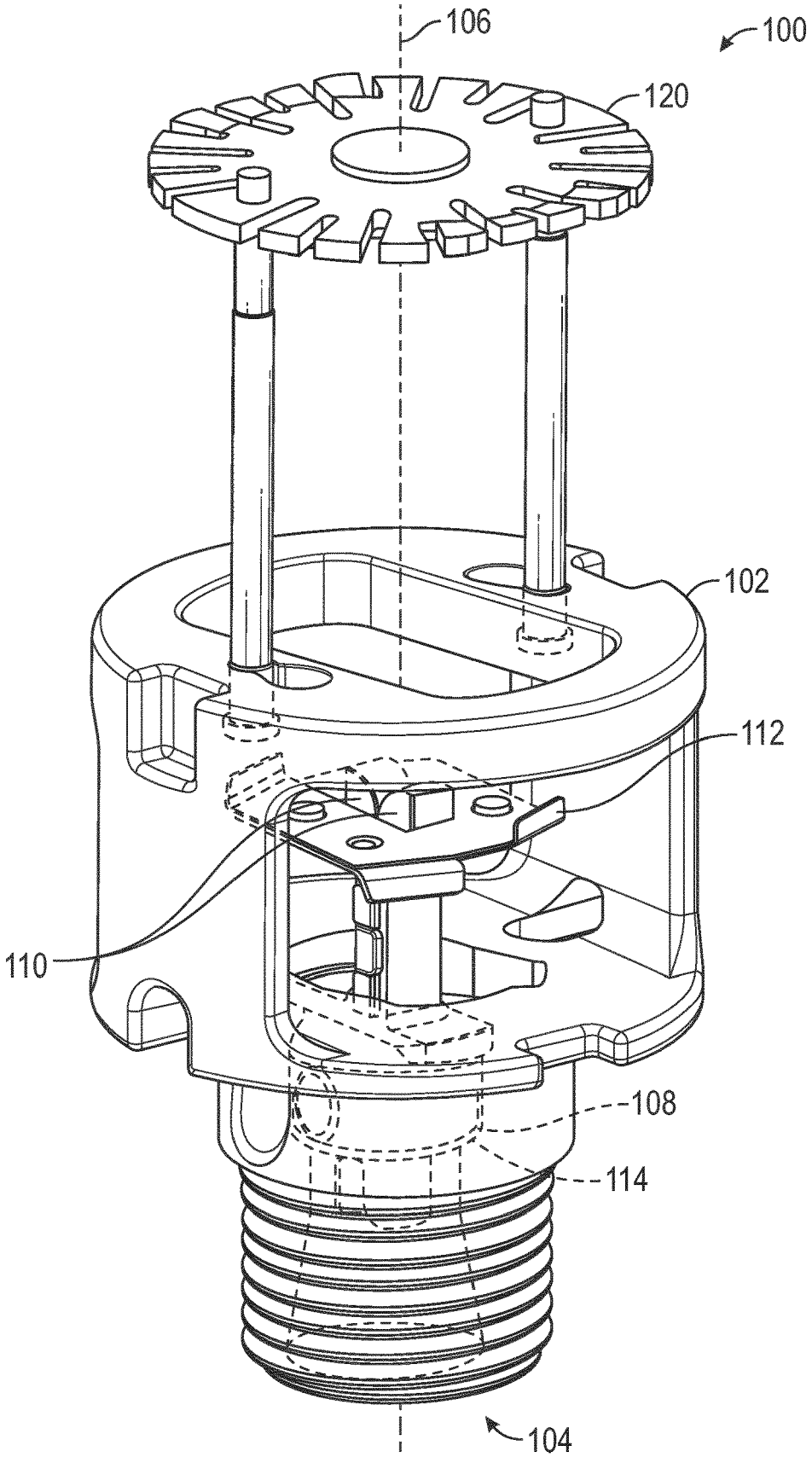
FIG. 2 is a perspective view of a sprinkler, according to an exemplary embodiment.

Referring to FIG. 2, the sprinkler 12 can be a fire sprinkler assembly, shown as sprinkler 100. The sprinkler 100 utilizes multiple components made from a polymeric material. In one embodiment, the polymeric material is glass fiber enforced polyphenylene sulfide (PPS) (e.g., Ryton R-4, Fortron). This material is ideal for a fire sprinkler application, as it is strong, corrosion resistant, and has no known solvents below 200 degrees Celsius. The polymeric material may be injection molded to form each of the components. This material is inherently corrosion resistant, and accordingly is well suited to prolonged contact with water or other types of fire-suppressants. Additionally, because the polymeric material can be injection molded, the components can be made to have a complex geometry quickly, easily, and at a low cost. Because of this, the sprinkler 100 can have a reduced part count relative to a metal sprinkler, reducing the costs and complexity of the assembly process. Injection molding of the components reduces the number of operations and associated pieces of equipment required to manufacture the sprinkler 100, thereby reducing the manufacturing costs and floor space required to manufacture the sprinkler 100.

In other embodiments, a different type of polymeric material is used. By way of example, other suitable polymeric materials may include: polyetheretherketone (PEEK); polyphthalamide (PPA) (e.g., Amodel, Ultramid); polyetherketoneketone (PEKK); polyimide (TPI) (e.g., Vespel); polyamide 6, 66, and 12 (PA6, PA66, and PA12) (e.g., Nylon, Zytel, long fiber Celstran); polysulfone (PSU); polyethersulfone (PES); polyetherimide (PEI) (e.g., Ultem); and polyamide-imide (PAI) (e.g., Torlon). Some such materials may be activated by heat curing after injection molding to further strengthen the components. Any of the polymers discussed herein may be reinforced (e.g., filled) with glass fibers, carbon fibers, aramid fibers, mica fibers, or other types of fibers. In yet other embodiments, some or all of the components are formed using a non-polymeric material such as metal (e.g., brass, stainless steel, etc.).

The sprinkler 100 includes a sprinkler body (e.g., a housing, a frame, etc.), shown as body 102, that defines an aperture, shown as inlet 104, configured to be fluidly coupled to the source 14 (e.g., through the conduit 16). The body 102 extends away from the inlet 104 along a longitudinal axis 106. A cap, plug, stopper, brace, or member, shown as button 108, is held in place by a pair of levers, shown as lever arms 110. The lever arms 110 are held against one another by a destructible element or assembly or activation element or assembly, shown as fusible link 112. When the sprinkler 100 is fully assembled, the lever arms 110 engage the body 102 and push against the button 108. The button 108 in turn pushes a conical spring seal, shown as spring seal 114, against the body 102. The spring seal 114 seals the inlet 104, preventing the fire suppressant fluid from escaping the sprinkler 100. When a heat source causes the temperature of the fusible link 112 to increase above a threshold temperature, the fusible link 112 comes apart. This permits the lever arms 110 to separate from one another and loosens the button 108 and the spring seal 114. The pressure of the fire suppressant fluid pushes against the button 108 and the spring seal 114, forcing the button 108, the lever arms 110, and the spring seal 114 out of the body 102, and the fire suppressant fluid is released from the sprinkler 100 into the surroundings. The sprinkler 100 further includes a deflector assembly, shown as deflector 120, coupled to the body 102. The deflector 120 is positioned such that the fire suppressant fluid strikes the deflector 120 immediately prior to leaving the sprinkler 100, spreading the fluid over a larger area. In FIG. 2, the sprinkler 100 is shown with the deflector 120 positioned above the body 102. It should be understood that the orientations of the components shown herein may be chosen to facilitate showing certain features, and these orientations may not represent the orientations of the components after installation and/or during operation. By way of example, once installed, the deflector 120 may be positioned below the body 102.

Button

Referring now to FIGS. 3-9, the button 108 is shown according to an exemplary embodiment. In this embodiment, the button 108 is injection molded as a single piece from polymeric material. The button 108 includes a central body, shown as main body 200. The main body 200 is cylindrical and extends along the longitudinal axis 106. The main body 200 defines a surface, shown as seal engagement surface 204. The seal engagement surface 204 extends perpendicular to the longitudinal axis 106 and is configured to engage the spring seal 114. A protrusion or projection, shown as tail 210, extends away from the main body 200 along the longitudinal axis 106. The tail 210 is positioned on the same side of the main body 200 as the seal engagement surface 204 such that the seal engagement surface 204 surrounds the tail 210.

Referring to FIGS. 10-18, the body 102 is shown according to an exemplary embodiment. In this embodiment, the body 102 is injection molded as a single piece from polymeric material. The body 102 includes a first section, shown as neck portion 240. The neck portion extends along and is substantially centered about the longitudinal axis 106. As shown, the neck portion 240 is threaded (e.g., with tapered threads, with NPT threads, etc.) to facilitate sealing engagement with the conduit 16 that provides the sprinkler 100 with a supply of pressurized fire suppressant fluid. In other embodiments, the neck portion 240 is otherwise coupled to the conduit 16 (e.g., through a quick-disconnect fitting, through a fitting having straight threads and a gasket, through a flared fitting, through a grooved coupling, through a compression fitting, etc.).

Figure 13:
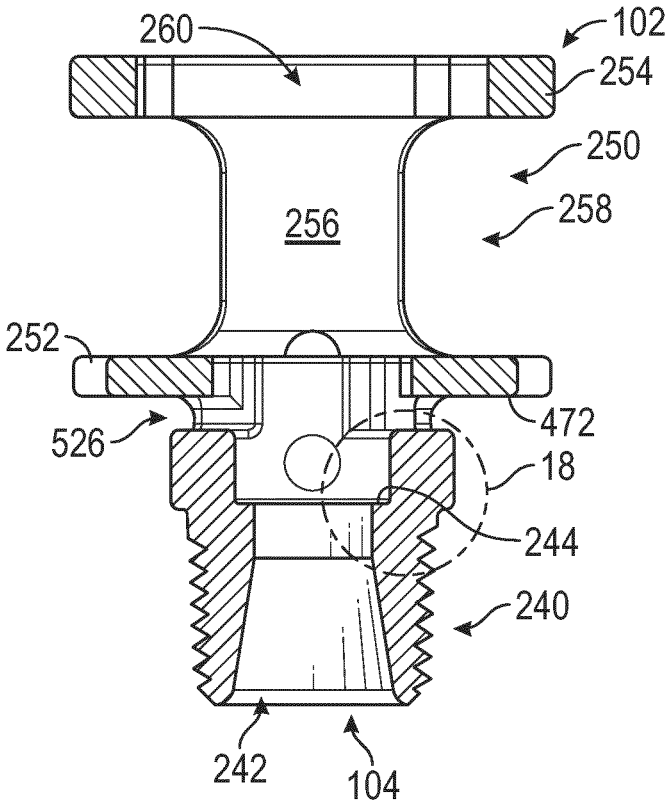
FIG. 13 is a right side section view of the body of FIG. 10.
Figure 14:
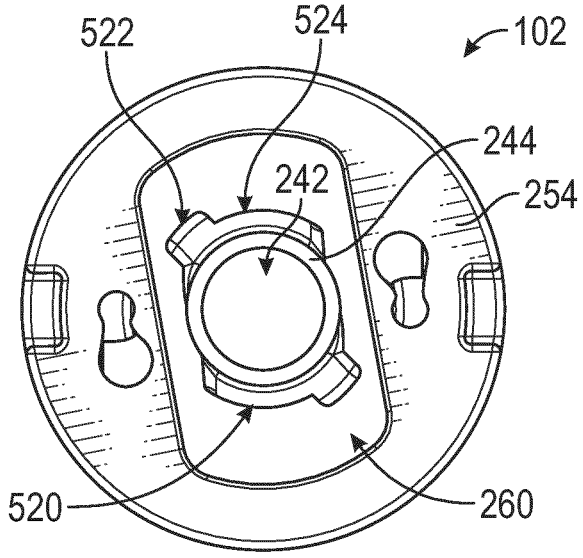
FIG. 14 is a top view of the body of FIG. 10.
Figure 15:
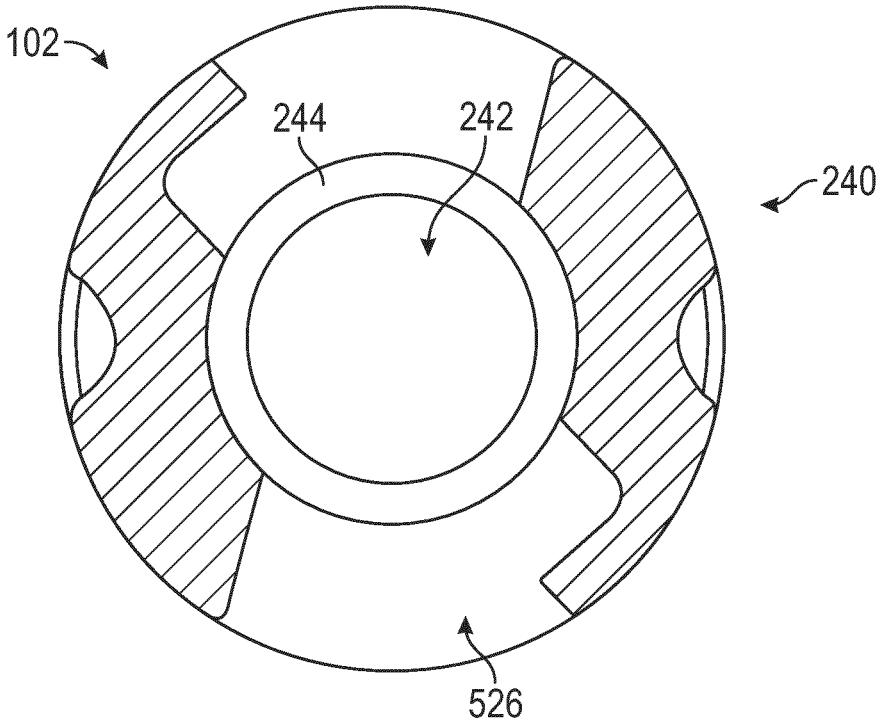
FIG. 15 is a top section view of the body of FIG. 10.
Figure 16:
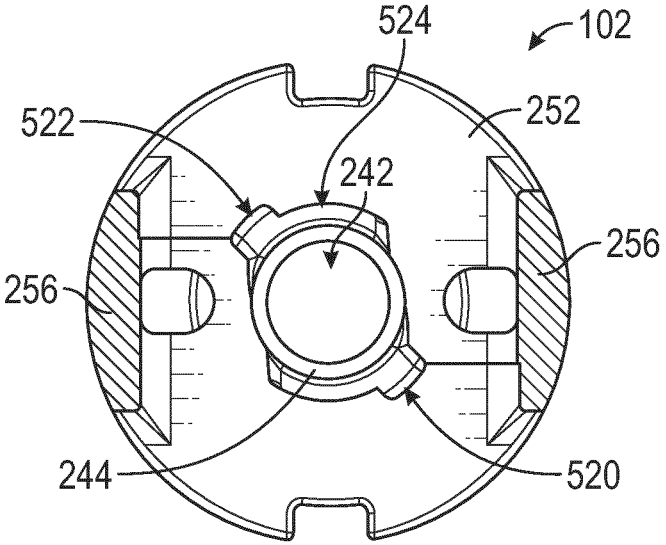
FIG. 16 is a top section view of the body of FIG. 10.
Figure 17:
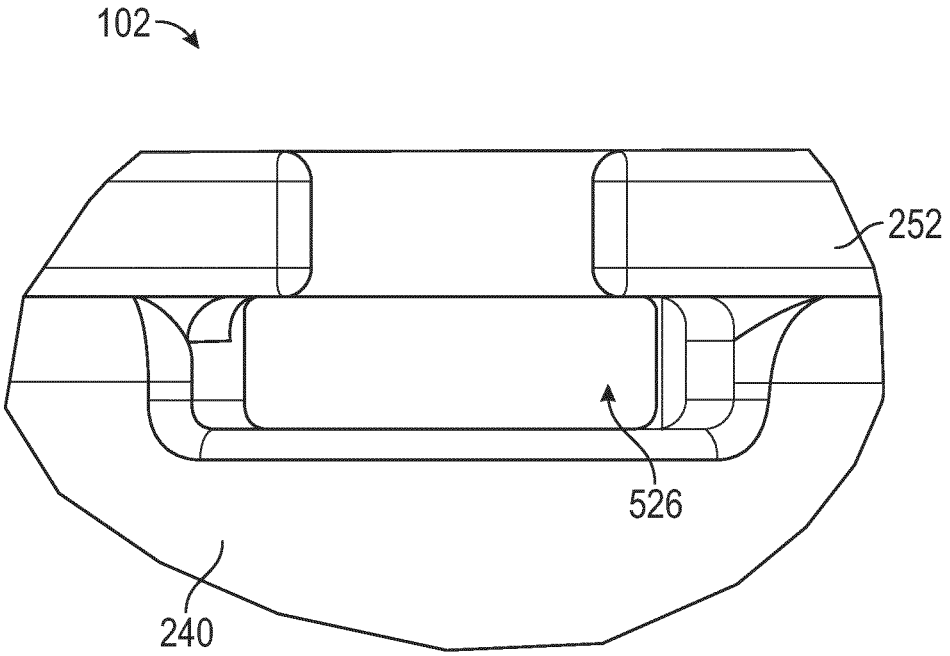
FIG. 17 is a detail view of the body of FIG. 10.
Figure 18:
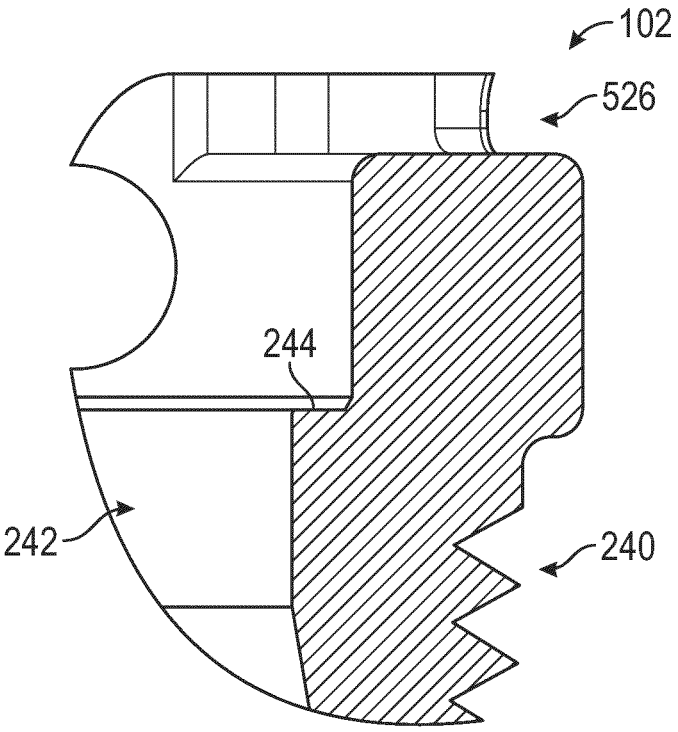
FIG. 18 is a detail section view of the body of FIG. 10.

The neck portion 240 defines a passage 242 extending along and centered about the longitudinal axis 106. The passage 242 begins at the inlet 104 and extends toward the opposite end of the body 102. As shown in FIGS. 13 and 18, the passage 242 gradually decreases in cross-sectional area as it extends away from the inlet 104, then sharply increases in cross-sectional area to define a seat or shoulder, shown as shoulder 244. The shoulder 244 is annular and extends substantially perpendicular to the longitudinal axis 106.

The body 102 further includes a second section, shown as cage portion 250, fixedly coupled (e.g., integrally formed with) the neck portion 240. The cage portion 250 is substantially cylindrical and also extends along and is substantially centered about the longitudinal axis 106. The cage portion 250 extends farther radially outward from the longitudinal axis 106 than the neck portion 240 (e.g., has a larger radius than the neck portion 240). The cage portion 250 includes two disk-shaped plates or members, shown as middle disk 252 and outer disk 254, each extending substantially perpendicular to the longitudinal axis 106. The middle disk 252 extends adjacent the neck portion 240, and the outer disk 254 is longitudinally offset from the middle disk 252. A pair of longitudinal members, shown as supports 256, extend directly between and couple the middle disk 252 and the outer disk 254. The supports 256 are diametrically opposed and extend substantially parallel to the longitudinal axis 106. A passage, shown as access passage 258, extends substantially perpendicular to the longitudinal axis 106 though the cage portion 250. Specifically, the access passage 258 extends between the middle disk 252, the outer disk 254, and the supports 256. The passage 242 intersects the access passage 258. The access passage 258 facilitates access to the passage 242 from the side of the body 102 opposite the inlet 104 (e.g., during assembly). The outer disk 254 defines an aperture, shown as outlet 260, extending therethrough. The outlet 260 is substantially centered about the longitudinal axis 106. The outlet 260 intersects the access passage 258. Accordingly, the inlet 104 is fluidly coupled to the outlet 260 in certain configurations of the sprinkler 100 (e.g., when the button 108 is removed from the sprinkler 100).

Figure 19:
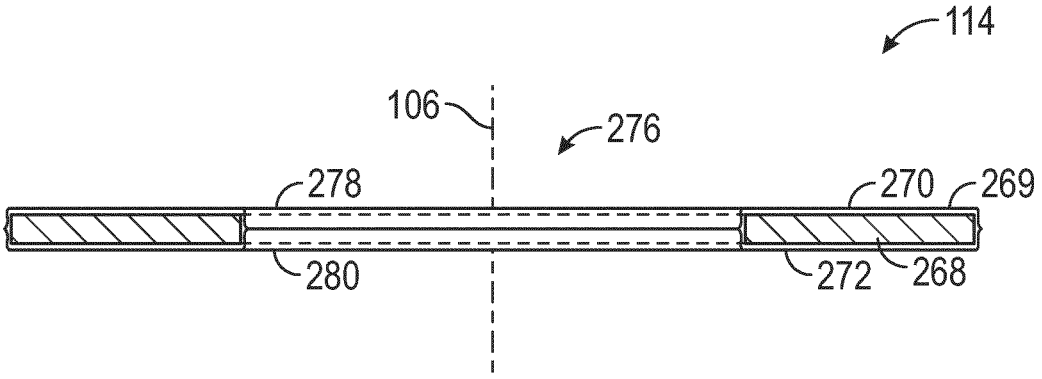
FIG. 19 is a front side section view of a conical spring seal of the sprinkler of FIG. 2 in a fully compressed state, according to an exemplary embodiment.
Figure 20:
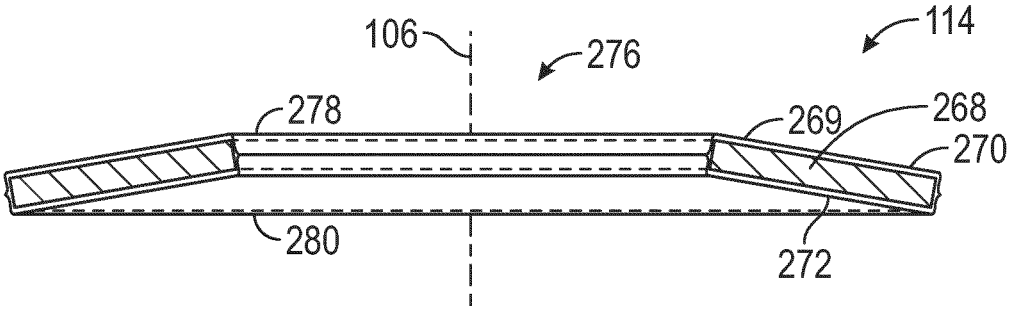
FIG. 20 is a front side section view of the conical spring seal of FIG. 19 in a free state.
Figure 21:
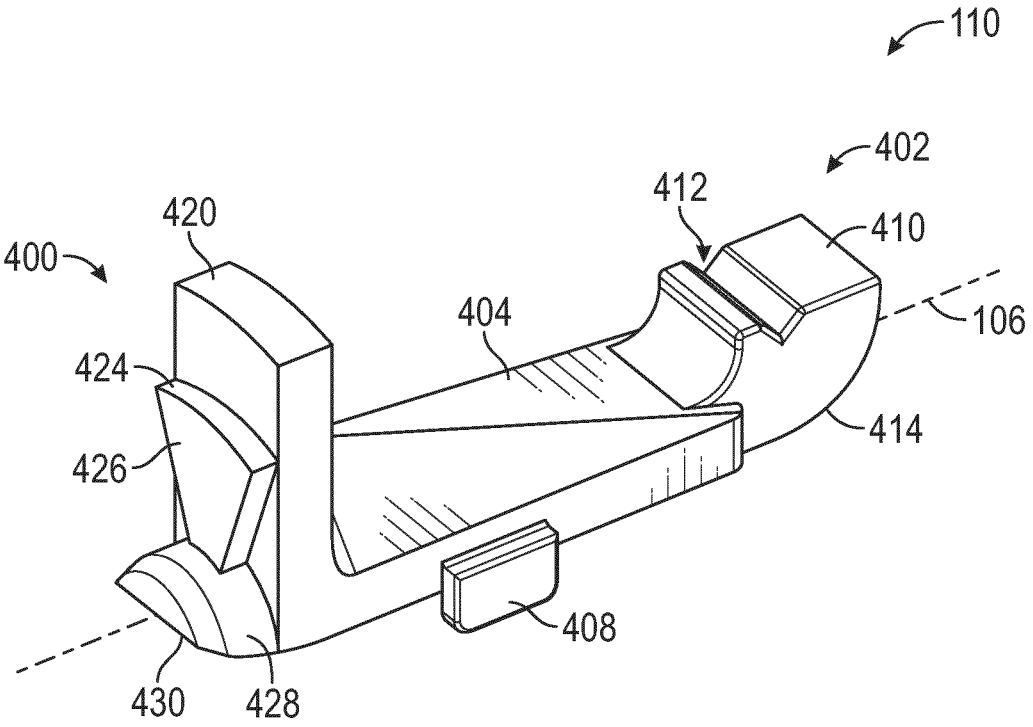
FIGS. 21 and 22 are perspective views of a lever arm of the sprinkler of FIG. 2, according to an exemplary embodiment.
Figure 22:
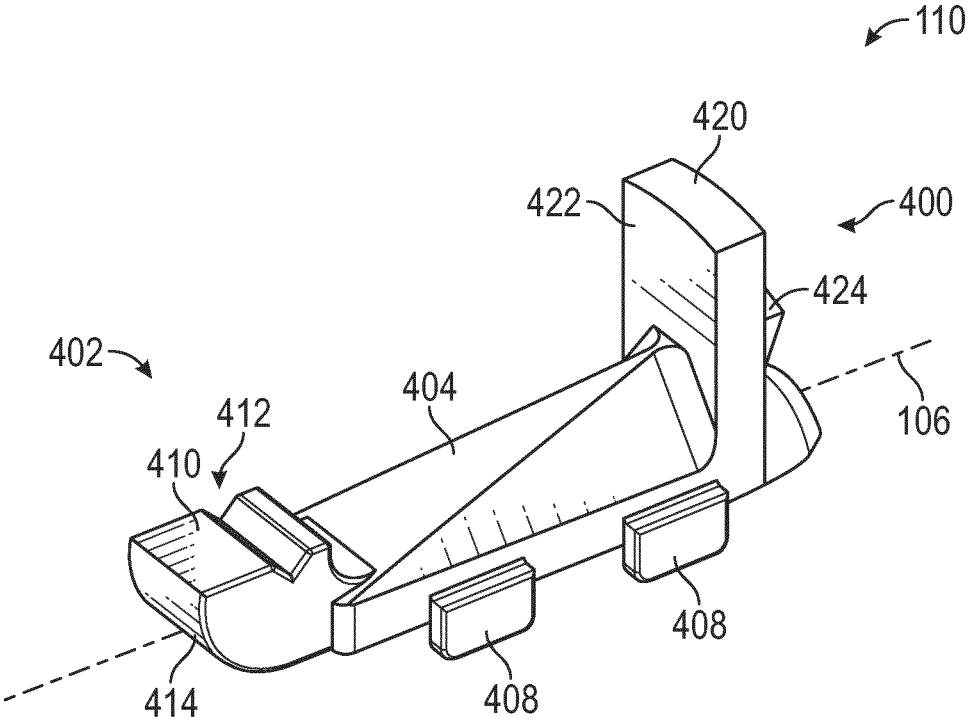

Referring to FIGS. 19 and 20, the spring seal 114 is shown according to an exemplary embodiment. The spring seal 114 is a type of spring seal configured to be compressed between two flat engagement surfaces, thereby preventing fluid from flowing between the two engagement surfaces. The spring seal 114 includes an annular spring base 268 formed from a piece of spring material (e.g., spring steel, etc.) that is covered in a layer of flexible coating 269 that facilitates sealing (e.g., PTFE, Teflon, etc.). When the spring seal 114 is compressed, the flexible coating 269 may conform to the shape of the components that it contacts, further increasing the sealing performance of the spring seal 114. The spring seal 114 defines two opposing sealing surfaces: a sealing surface 270 and a sealing surface 272. In some embodiments, the sealing surface 270 and the sealing surface 272 extend substantially parallel to one another. The spring seal 114 is annular such that the sealing surface 270 and the sealing surface 272 are both annular. The spring seal 114 defines an aperture, shown as central aperture 276, positioned at the center of the spring seal 114. Once the sprinkler 100 is assembled, the longitudinal axis 106 extends through the center of the spring seal 114.

In normal operation, the spring seal 114 is compressed to move between two states or configurations: an uncompressed, relaxed, or free state shown in FIG. 20, and a fully compressed state shown in FIG. 19. In the relaxed state, the sealing surface 270 and the sealing surface 272 are substantially frustoconical and oriented at an angle between 0 and 90 degrees relative to the longitudinal axis 106. In the fully compressed state, the sealing surface 270 and the sealing surface 272 are substantially flat and oriented substantially perpendicular to the longitudinal axis 106. When placed between two flat engagement surfaces, a first edge, shown as edge 278, engages the first flat engagement surface, and a second edge, shown as edge 280, engages the second engagement surface. The edge 278 is located on the sealing surface 270 and adjacent the central aperture 276. The edge 280 is located on the sealing surface 272 and opposite the central aperture 276. As the spring seal 114 is compressed, the sealing surfaces 270 and 272 flatten until the spring seal 114 reaches the fully compressed state. In the fully compressed state the spring seal 114 provides peak sealing performance. Deforming the spring seal 114 beyond the fully compressed state (e.g., such that the sealing surfaces 270 and 272 become angled in the opposite direction) overextends the spring seal 114, which can cause it to permanently deform and no longer seal properly.

To begin assembly of the sprinkler 100, the spring seal 114 is coupled to the button 108. Specifically, the tail 210 is inserted into the central aperture 276 of the spring seal 114 such that the edge 278 engages the seal engagement surface 204. The flexible coating 269 and the central aperture 276 are sized such that the flexible coating 269 is deformed by the tail 210, pressing against the tail 210 and removably coupling the spring seal 114 to the button 108. This facilitates assembly without the spring seal 114 falling off of the button 108. The subassembly including the button 108 and the spring seal 114 is then placed into the passage 242 such that the edge 280 of the sealing surface 272 engages the shoulder 244. At this point, the button 108 and the spring seal 114 are roughly aligned with the longitudinal axis 106 through contact with the walls of the passage 242. The button 108 is forced against the spring seal 114 until the spring seal 114 reaches the fully compressed state and the inlet 104 is fluidly decoupled from the outlet 260. The button 108 is held in this position (e.g., by a fixture) in preparation for receiving the lever arms 110.

Lever Arms

Figure 26:
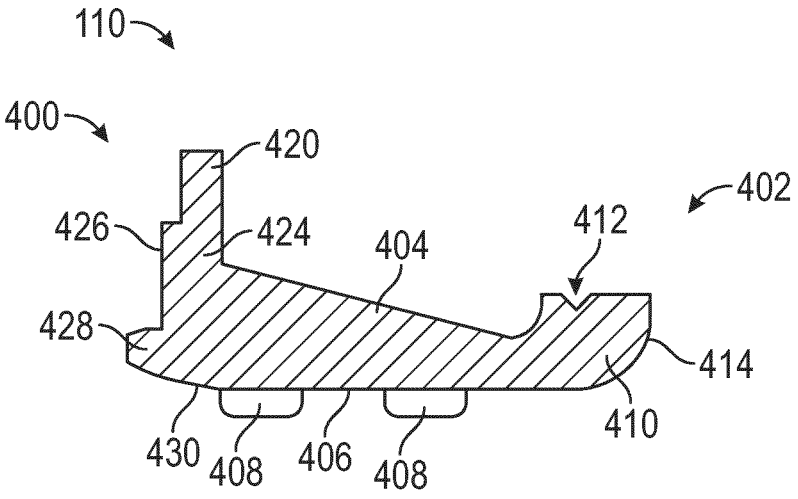
FIG. 26 is a right side section view of the lever arm of FIG. 21.
Figure 27:
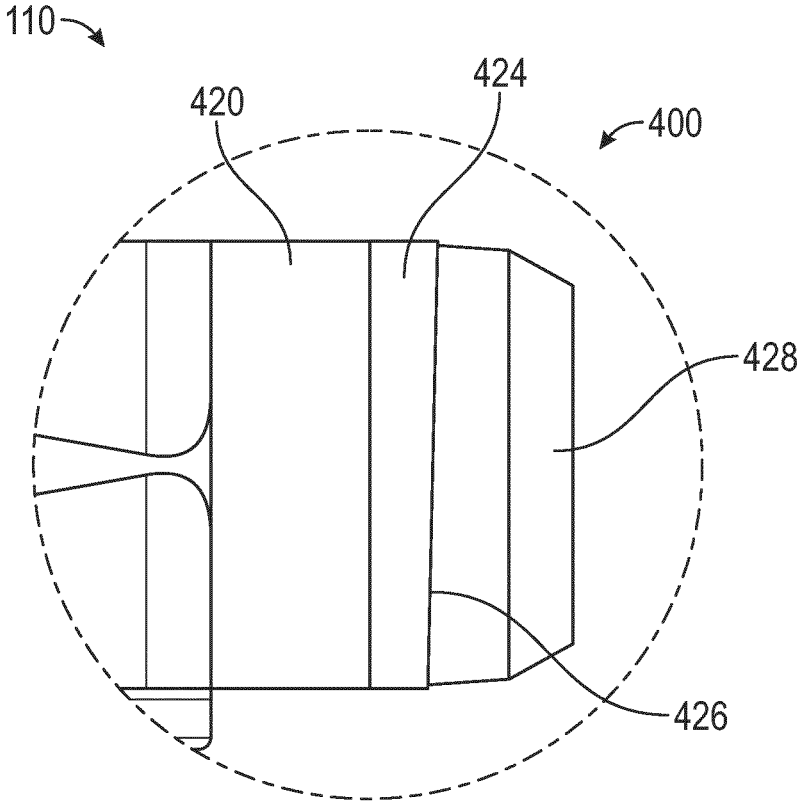
FIG. 27 is a detail view of the lever arm of FIG. 21.

Referring to FIGS. 21-27, the lever arms 110 are in some embodiments identical (e.g., identically sized, identically shaped, etc.). In this embodiment, each lever arm 110 is injection molded as a single piece from polymeric material. Each lever arm 110 has a first end, shown as base end 400, and a second end, shown as tip end 402, opposite the base end 400. Each lever arm 110 includes a body portion or body section, shown as main body 404. As shown in FIG. 26, the main body 404 defines a flat surface 406. When the sprinkler 100 is assembled, the longitudinal axis 106 extends along the flat surface 406. A series of projections, shown as alignment tabs 408, extend from the main body 404 beyond the flat surface 406. Two alignment tabs 408 extend from one side of the main body 404, and one alignment tab 408 extends from the opposite side of the main body 404. All of the alignment tabs 408 extend in the same lateral direction. Each alignment tab 408 has the same length in the longitudinal direction. The pair of alignment tabs 408 that extend on the same side of the main body 404 are longitudinally offset from one another approximately the length of one alignment tab 408. The alignment tab 408 on the opposite side is longitudinally centered between the other two alignment tabs 408.

Figure 23:
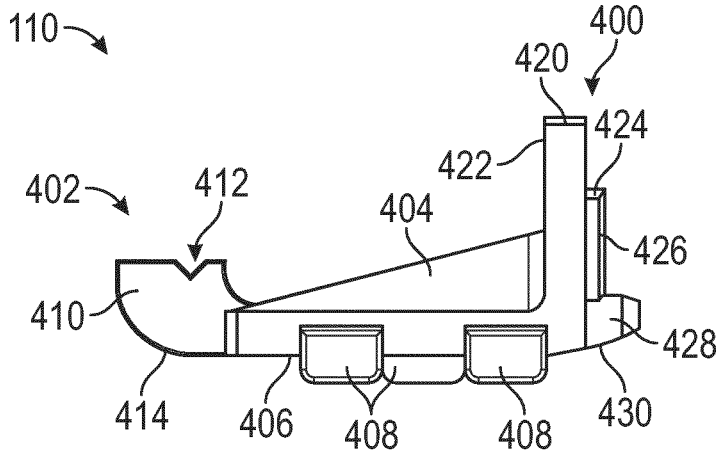
FIG. 23 is a left side view of the lever arm of FIG. 21.
Figure 24:
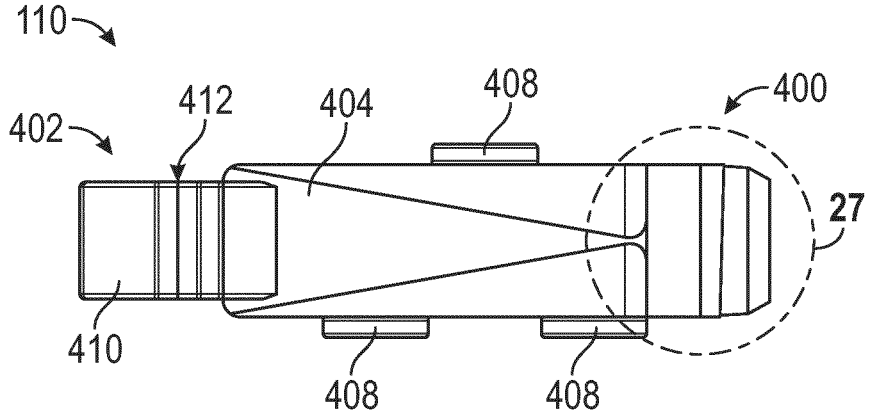
FIG. 24 is a top view of the lever arm of FIG. 21.
Figure 25:
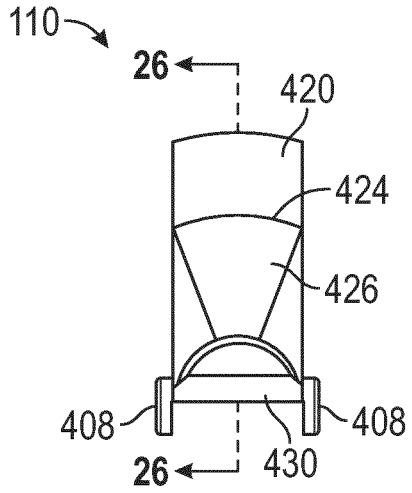
FIG. 25 is a front side view of the lever arm of FIG. 21.

At the tip end 402 of the lever arm 110 is a head portion or head section, shown as head 410, extending longitudinally away from the main body 404. The head 410 defines a notch, slot, recess, or groove, shown as notch 412. The notch 412 extends from a side of the head 410 opposite the flat surface 406 toward the flat surface 406. The notch 412 extends substantially perpendicular to the longitudinal axis 106 from one side of the head 410 to an opposite side of the head 410. As shown in FIG. 23, the notch 412 has a substantially triangular cross-section. The head 410 further defines a curved, radiused, or arcuate surface, shown as curved surface 414. The curved surface 414 extends from the flat surface 406 toward the tip end 402 and away from the longitudinal axis 106. The curved surface 414 may have a constant radius of curvature, or another type of curvature. In one embodiment, the radius of the curved surface 414 is centered about an axis extending along a length of the notch 412 through the deepest point of the notch 412.

At the base end 400 of the lever arm 110 is a protrusion, a leg portion, or a leg section, shown as leg 420, extending substantially perpendicular to the longitudinal axis 106 and away from the flat surface 406. The leg 420 meets the main body 404, and the thickness of the main body 404 increases gradually toward the leg 420. The leg 420 defines a flat surface, shown as engagement surface 422. The engagement surface 422 faces toward the tip end 402 and is substantially perpendicular to the body 404. On the opposite side of the leg 420 is a ramp, shown as helical ramp 424, that faces away from the tip end 402. Each helical ramp 424 defines a lever engagement surface (e.g., a helical, angled, or ramped surface), shown as ramped engagement surface 426. The curvature of the helical engagement surface 426 is centered about the longitudinal axis 106. Each helical ramp 424 extends approximately 41 degrees around the longitudinal axis 106. In other embodiments, the helical ramp 424 extends a different length around the longitudinal axis 106. A protrusion, shown as centering post 428, extends longitudinally from the leg 420 away from the tip end 402. The centering post 428 has a circular curvature centered about the longitudinal axis 106. The leg 420 and the centering post 428 together define a curved, radiused, or arcuate surface, shown as curved surface 430, opposite the circular curvature of the centering post 428. The curved surface 430 extends from the flat surface 406 toward the base end 400 and away from the longitudinal axis 106. The curved surface 430 can have a constant radius curvature or another type of curvature. The curvature of the curved surface 430 facilitates separation of the lever arms 110 during activation of the sprinkler 100 within the confined space defined by the body 102. In an alternative embodiment, the curved surface 430 is chamfered instead of curved.

Figure 28:
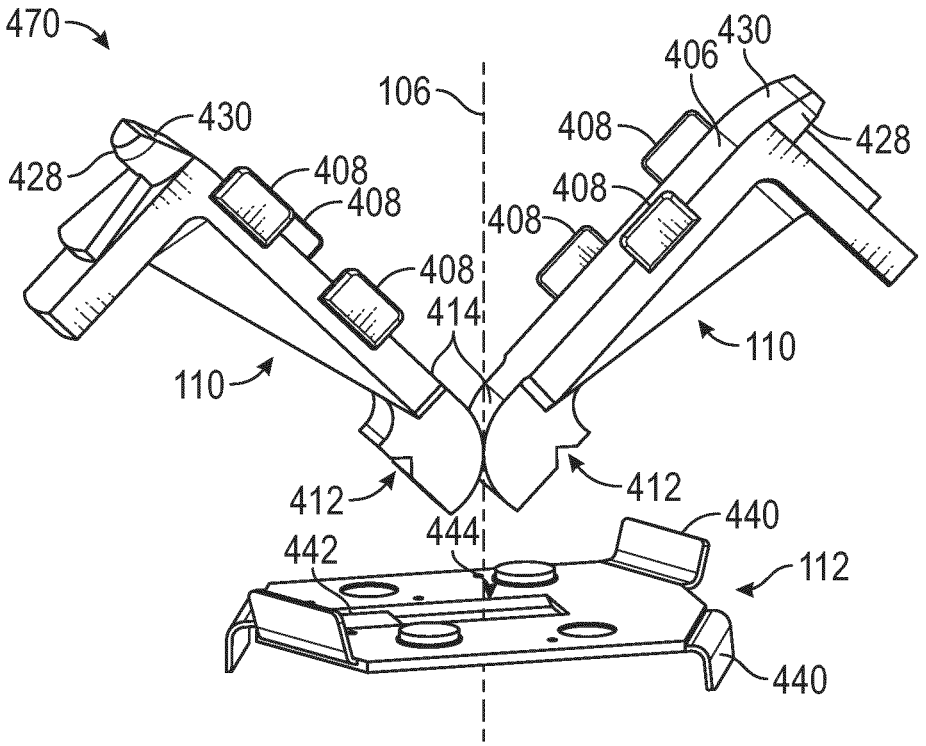
FIGS. 28 and 29 are perspective views of a link and lever assembly of the sprinkler of FIG. 2, according to an exemplary embodiment.
Figure 29:
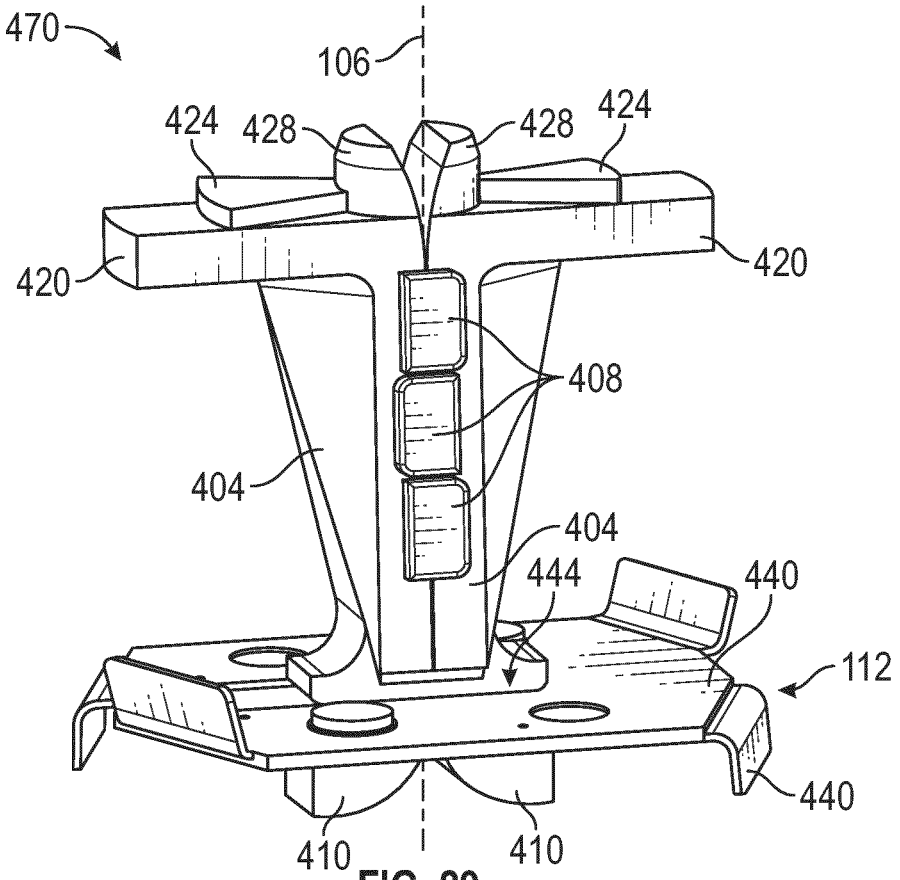

Referring to FIGS. 28 and 29, the fusible link 112 is shown according to an exemplary embodiment. The fusible link 112 includes a pair of plates 440. The plates 440 can be made from a metal, such as nickel. Each plate 440 defines a slot, groove, recess, or notch, shown as slot 442, that extends from near the center of the plate 440 to the edge of the plate 440. The plates 440 are coupled together with a solder alloy that melts at a threshold temperature T, decoupling the plates 440 from one another. In some embodiments, the threshold temperature T is 165 degrees Fahrenheit or 212 degrees Fahrenheit. In other embodiments, the threshold temperature T is another temperature. When assembled, the slots 442 overlap and face opposing directions, forming an aperture 444.

Figure 3:
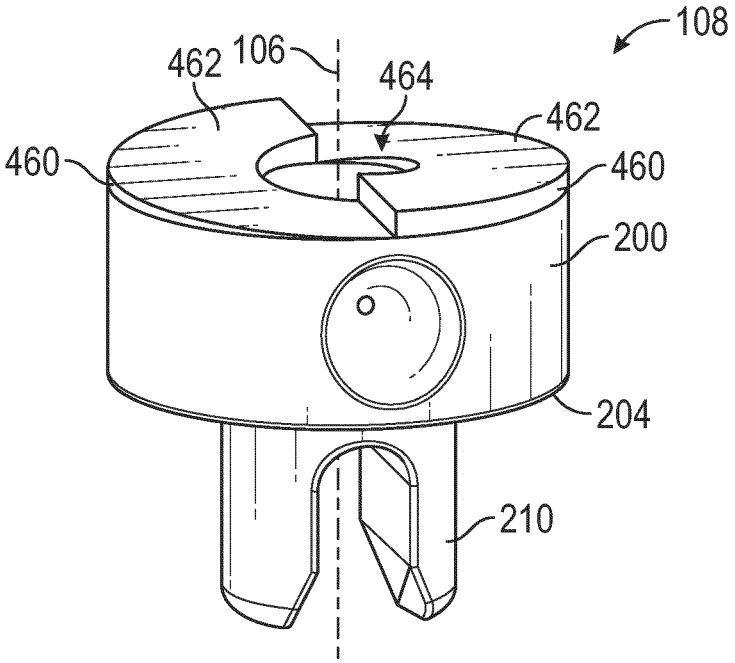
FIGS. 3-5 are perspective views of a button of the sprinkler of FIG. 2, according to an exemplary embodiment.
Figure 4:
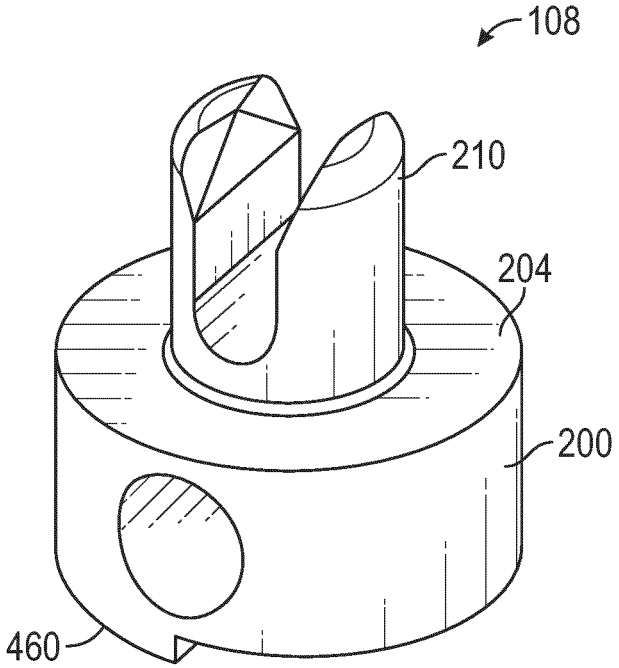
Figure 5:
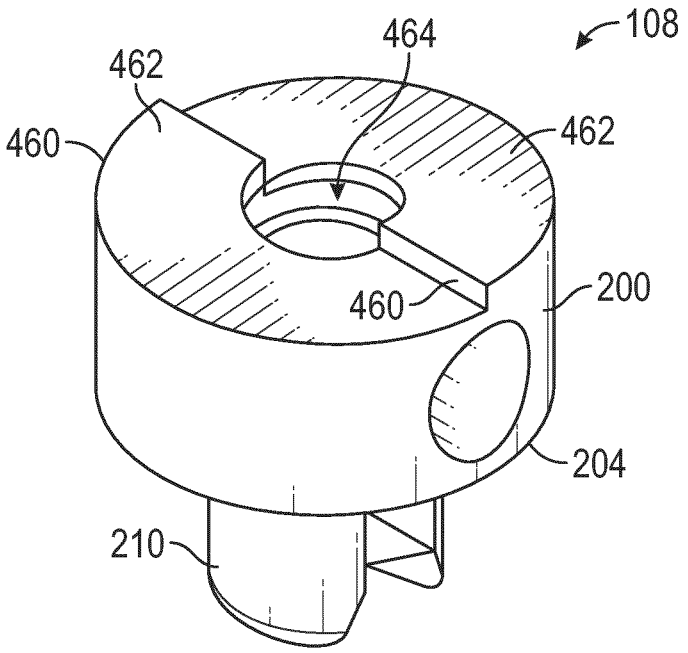
Figure 6:
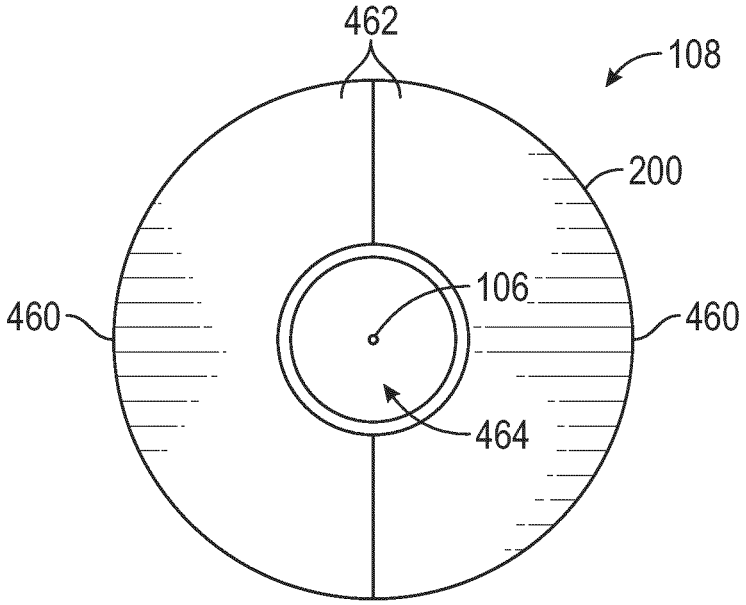
FIG. 6 is a top view of the button of FIG. 3.
Figure 7:
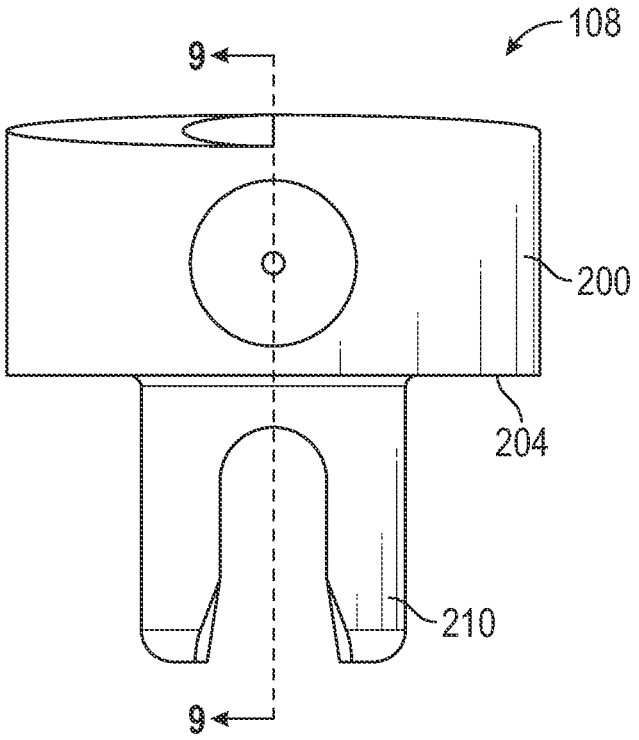
FIG. 7 is a right side view of the button of FIG. 3.
Figure 8:
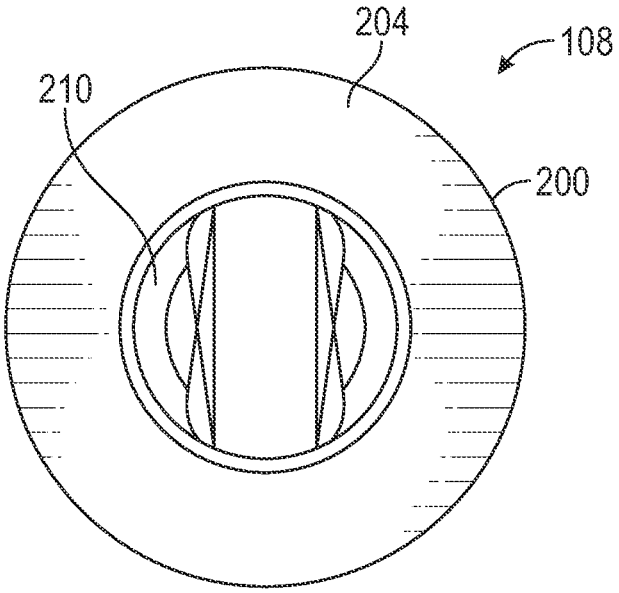
FIG. 8 is a bottom view of the button of FIG. 3.
Figure 9:
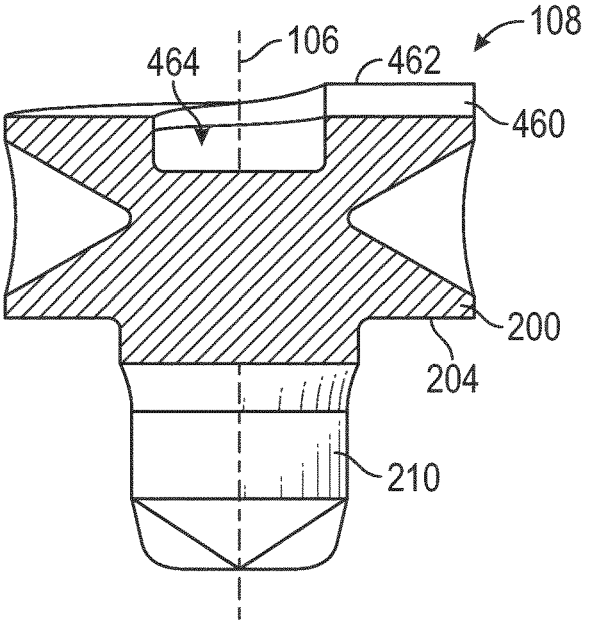
FIG. 9 is a front side section view of the button of FIG. 3.
Figure 10:
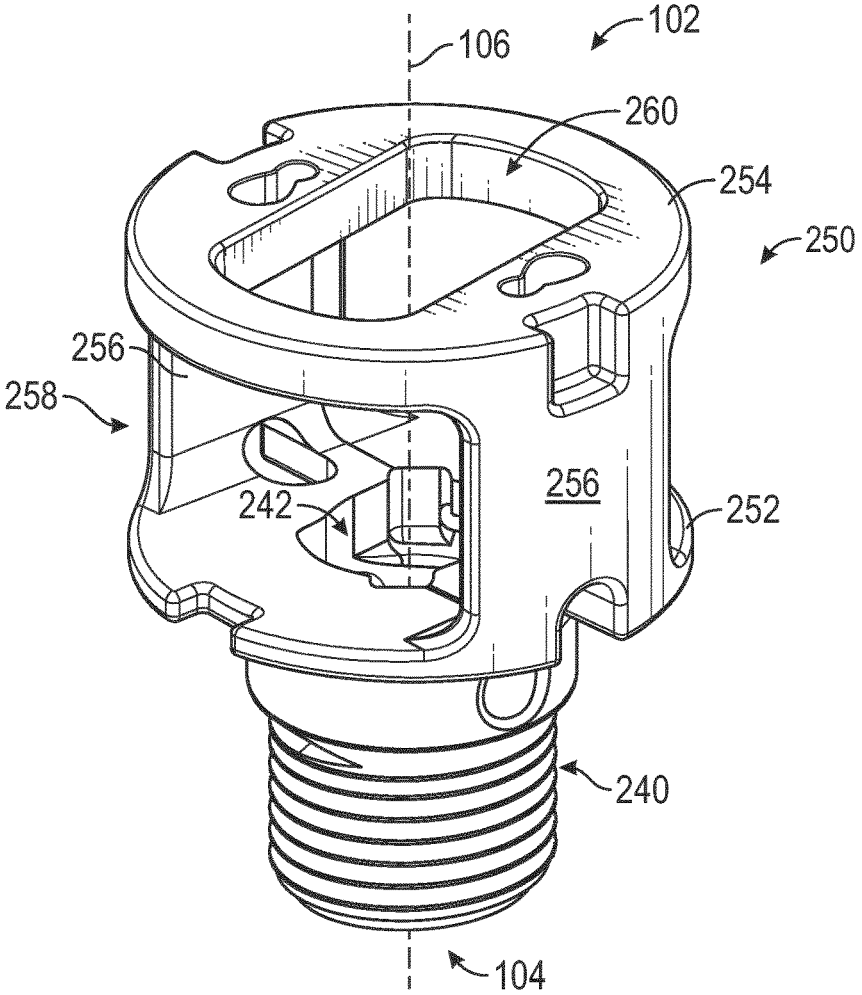
FIG. 10 is a perspective view of a body of the sprinkler of FIG. 2, according to an exemplary embodiment.
Figure 11:
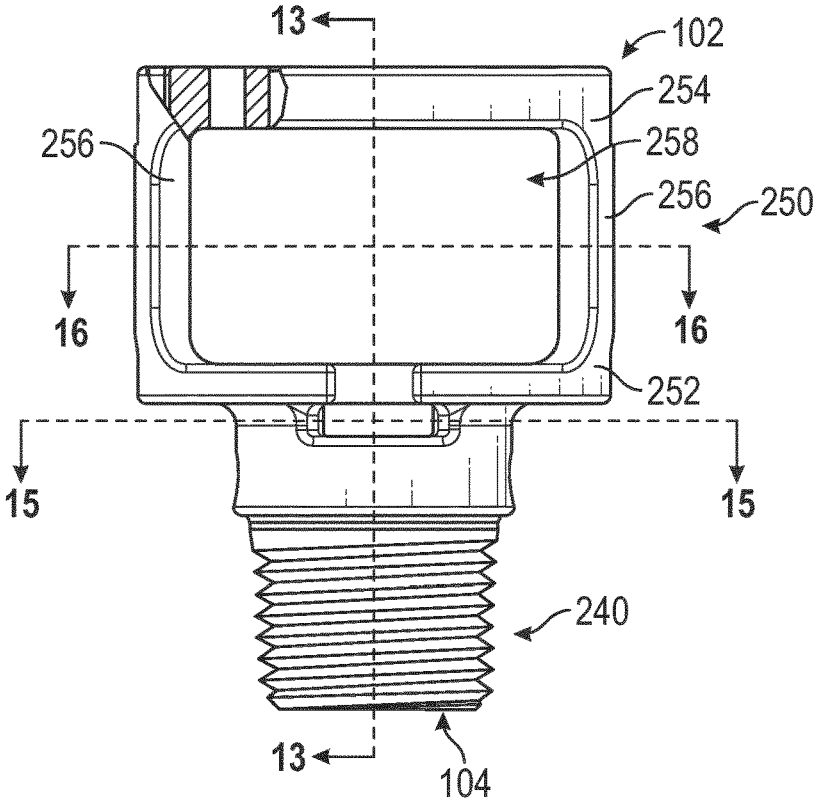
FIG. 11 is a partial front side section view of the body of FIG. 10.
Figure 12:
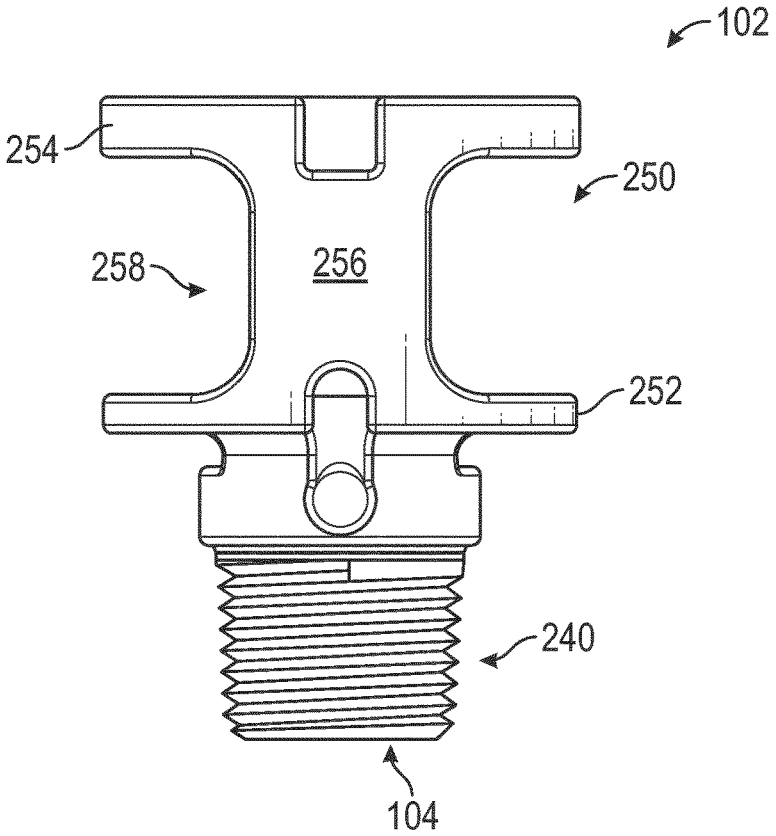
FIG. 12 is a right side view of the body of FIG. 10.

Referring FIGS. 3,5, and 6, on the side of the main body 200 opposite the seal engagement surface 204, the button 108 includes a pair of ramps, ramp sections, or ramp portions, shown as helical ramps 460, extending away from the main body 200. Each helical ramp 460 defines a button engagement surface, shown as helical engagement surface 462. The helical ramps 460 are centered about the longitudinal axis 106, and each helical ramp 460 extends approximately 180 degrees around the longitudinal axis 106. Centered between the helical ramps 460 is a circular recess, aperture, or hole, or centering recess, shown as central recess 464. The central recess 464 is centered about and extends along the longitudinal axis 106.

FIGS. 28-33 illustrate a method 500 of assembling the sprinkler 100. Specifically, FIGS. 28-33 illustrate the process of assembling the body 102, the lever arms 110, and the fusible link 112. The method 500 can be followed immediately after the button 108 and the spring seal 114 are inserted into the body 102 and the spring seal 114 is compressed. In step 502 of the method 500, the lever arms 110 and the fusible link 112 are assembled to form an activation element or activation assembly, shown as link and lever assembly 470. To begin, the pair of the lever arms 110 are oriented such that the curved surfaces 414 engage one another. In this configuration, shown in FIG. 28, the notches 412 both face in the same longitudinal direction. The heads 410 are then inserted into the aperture 444 until the notches 412 align with the plates 440. The lever arms 110 are then rotated until the flat surfaces 406 engage one another. At this point, the link and lever assembly 470 is fully assembled. In this configuration, the curved surfaces 414 face one another and the curved surfaces 430 face one another.

In this configuration, shown in FIG. 29, the alignment tabs 408 of each lever arm 110 receive the main body 404 of the other lever arm 110 therebetween, preventing movement of the lever arms 110 relative to one another perpendicular to the longitudinal axis 106. The alignment tabs 408 also interlock (e.g., extend between one another), preventing movement of the lever arms 110 relative to one another along the longitudinal axis 106. Specifically, each pair of alignment tabs 408 that extend from the same side of the main body 404 receive the single alignment tab 408 from the other side of the other main body 404 therebetween. In some embodiments, the corners of each of the alignment tabs 408 are radiused to facilitate clearance between the alignment tabs 408 when the lever arms 110 are rotated into the position shown in FIG. 29. If a force is applied to one of the lever arms 110 in a longitudinal direction, the alignment tabs 408 interfere with one another, preventing relative movement. In this configuration, the notches 412 face opposite directions, each receiving one of the plates 440. Accordingly, the fusible link 112 is prevented from moving relative to the lever arms 110. Through each of these connections, the link and lever assembly 470 passively holds itself together, facilitating insertion into the body 102.

Referring to FIGS. 14, 16, 17, and 30, the middle disk 252 of the body 102 defines an aperture, shown as link aperture 520, that is configured to receive the link and lever assembly 470 therethrough. The link aperture 520 can define a portion of the passage 242. The link aperture 520 is centered about the longitudinal axis 106. The link aperture 520 includes two sections: an entry section 522 and holding section 524. The entry section 522 has a radius greater than the distance between the longitudinal axis 106 and the end of the leg 420. The holding section 524 has a radius smaller than the radius of the entry section 522 and smaller than the distance between the longitudinal axis 106 and the end of the leg 420. The entry section 522 and the holding section 524 each have at least two diametrically opposed portions (e.g., to facilitate passage of the legs 420 through the entry section 522, to prevent the legs 420 from exiting the holding section 524, etc.). The entry section 522 is angularly offset about the longitudinal axis 106 from the holding section 524. Between the middle disk 252 and the neck portion 240, the body 102 defines a recess, cutout, aperture, or passage, shown as passage 526 in FIG. 17. The passage 526 extends perpendicular to the longitudinal axis 106 and can extend partway or entirely through the body 102.

Figure 30:
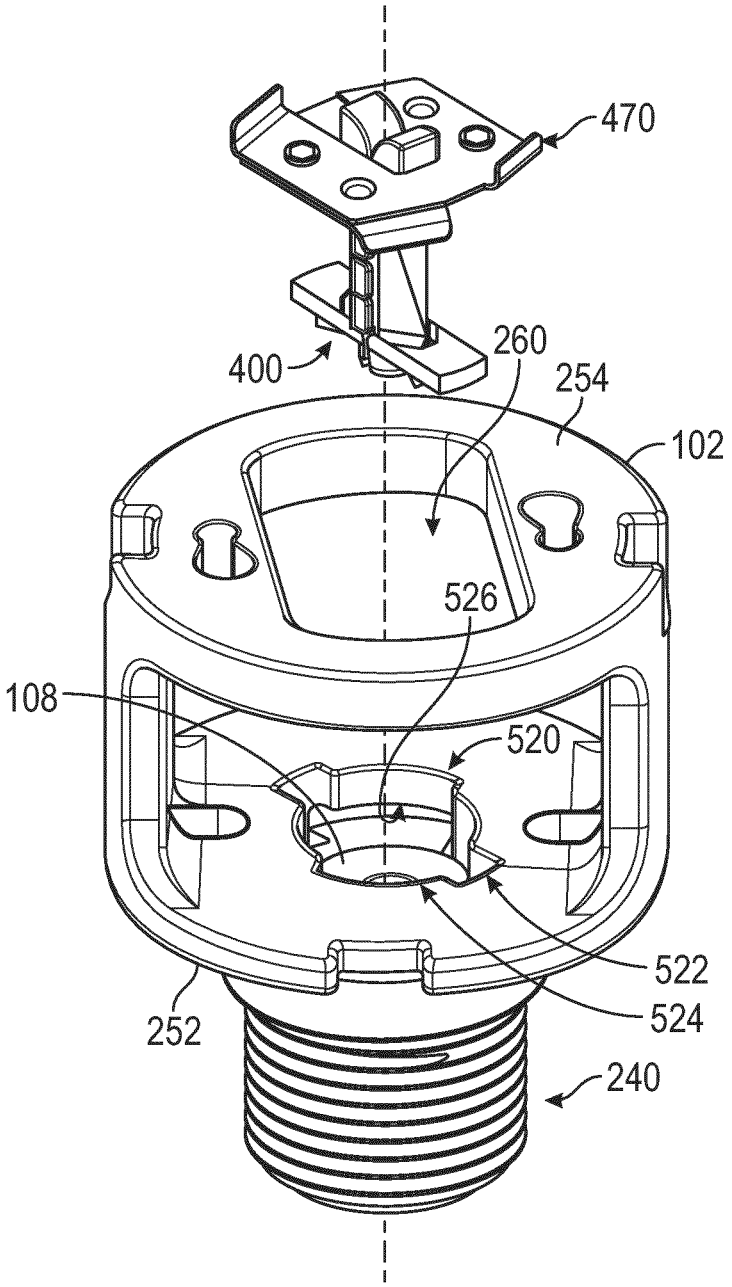
FIG. 30 is a partial exploded perspective view of the sprinkler of FIG. 2.

In step 504 of the method 500, the link and lever assembly 470 is inserted into the body 102, as shown in FIG. 30. This process can be completed by hand. Alternatively, a tool can utilize a magnet to engage the fusible link 112 and facilitate positioning of the link and lever assembly 470. The link and lever assembly 470 is inserted into the body 102 through the outlet 260 with the base ends 400 of the lever arms 110 entering the outlet 260 first. The link and lever assembly 470 is oriented such that the legs 420 align with the entry section 522 of the link aperture 520, and the link and lever assembly 470 is inserted through the link aperture 520 and into the passage 526. As shown in FIG. 29, the circular curvatures of the centering posts 428 together form a substantially cylindrical protrusion having a diameter that is substantially similar to that of the central recess 464 of the button 108. The centering posts 428 are received within the central recess 464, and contact between the centering posts 428 and the button 108 centers the link and lever assembly 470 along the longitudinal axis 106. The link and lever assembly 470 is then rotated clockwise as viewed in FIG. 30 such that the legs 420 rotate directly beneath the holding section 524 of the link aperture 520. Because a radius of the holding section is less than the distance between the longitudinal axis 106 and the end of the leg 420, the body 102 holds the link and lever assembly 470 within the body 102.

Figure 31:
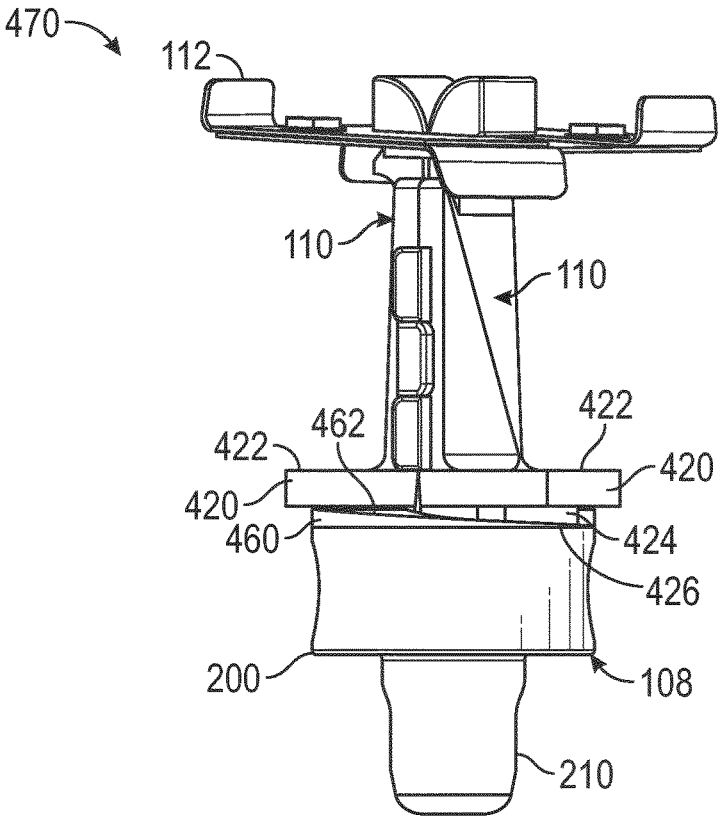
FIGS. 31 and 32 are side views of the button of FIG. 3 and the link and lever assembly of FIG. 28.
Figure 32:
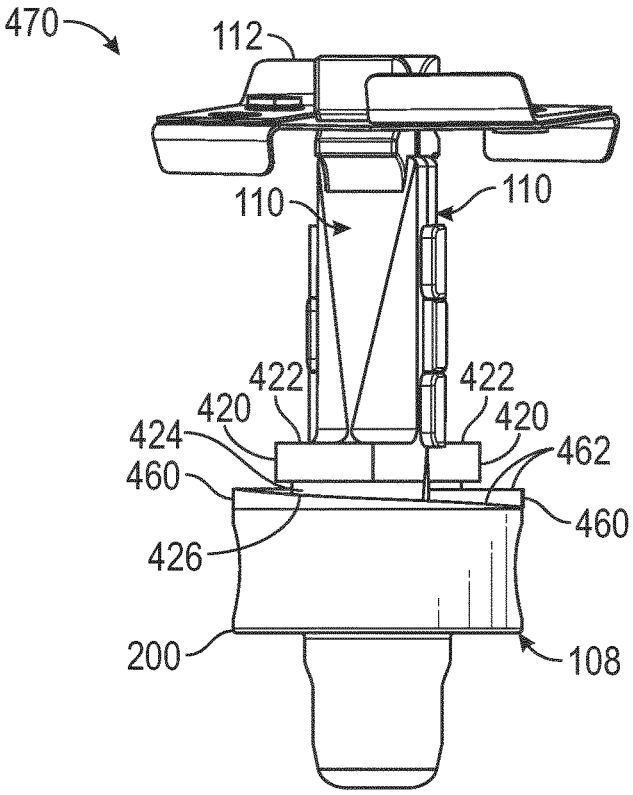
Figure 33:
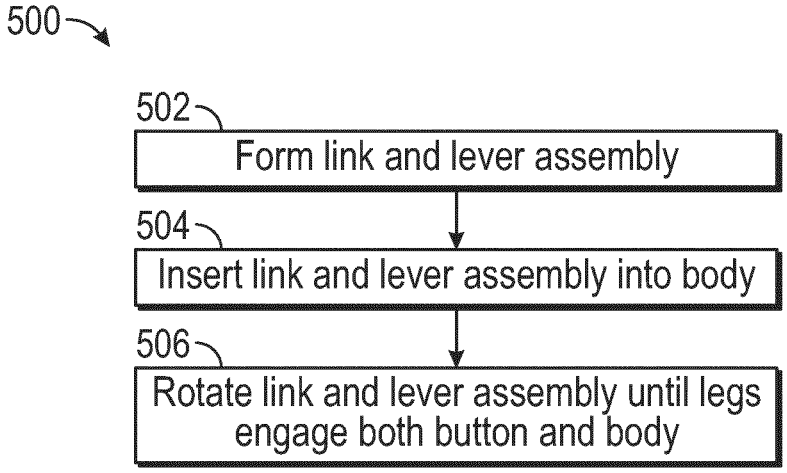
FIG. 33 is a block diagram illustrating a method of assembling a sprinkler, according to an exemplary embodiment.

In step 506 of the method 500, the link and lever assembly 470 is rotated into its desired position. As shown in FIGS. 31 and 32, in this configuration, the helical engagement surface 426 of each lever arm 110 engages a corresponding helical engagement surface 462 of the button 108. The helical engagement surfaces 426 and the helical engagement surfaces 462 both have corresponding slopes and curvatures. Accordingly, when the link and lever assembly 470 is rotated relative to the button 108, the relative longitudinal positioning between the link and lever assembly 470 and the button 108 changes. After the button 108 and the spring seal 114 are assembled with the body 102, the button 108 is held in place relative to the body 102 (e.g., by a fixture). Accordingly, rotating the link and lever assembly 470 relative to the body 102 causes the link and lever assembly 470 to move along the longitudinal axis 106. Specifically, rotating the link and lever assembly 470 clockwise as shown in FIG. 30 causes it to move upward as shown in FIG. 30. In one embodiment, the link and lever assembly 470 is capable of 29 degrees of rotation which corresponds to 0.005 inches of longitudinal movement. This facilitates assembly accounting for manufacturing tolerance in the longitudinal dimensions of the body 102, the button 108, the lever arms 110, and the spring seal 114. In other embodiments, the link and lever assembly 470 is capable of more or less than 29 degrees of rotation and/or more or less than 0.005 inches of longitudinal movement.

The link and lever assembly 470 is rotated until the engagement surfaces 422 of the legs 420 engage a body engagement surface (e.g., a flat surface), shown in FIG. 13 as engagement surface 472, on the middle disk 252. Once this occurs, the link and lever assembly 470 is held in place between the button 108 and the middle disk 252. The link and lever assembly 470 imparts a longitudinal force on the button 108 and the body 102 to hold the button 108 in place. The magnitude of this force and the quality of the seal provided by the spring seal 114 are determined by the compression of the spring seal 114. While the link and lever assembly 470 is rotated, the button 108 may be held in place in a longitudinal position corresponding to the desired compression of the spring seal 114. The longitudinal force corresponds to the rotational position of the link and lever assembly 470 once the link and lever assembly 470 has been rotated into place. A tool (e.g., the tool incorporating the magnet) can be used to control the torque imparted on the link and lever assembly 470. In one embodiment, the tool is a torque-limiting screwdriver. The link and lever assembly 470 is rotated until the torque imparted on the link and lever assembly 470 reaches a threshold torque corresponding to a desired longitudinal force. In one embodiment, the threshold torque is a minimal torque that indicates that the link and lever assembly 470 has just contacted both the engagement surface 472 and the helical engagement surfaces 462. The button 108, the spring seal 114, and the link and lever assembly 470 are then fully installed in within the body 102. The tool used to install the link and lever assembly 470 can then be removed. Friction between the button 108, the lever arms 110, and the body 102 then holds the link and lever assembly 470 in place. In some embodiments, the engagement surface 472, the helical engagement surfaces 426, and/or the helical engagement surfaces 462 are coated, textured (e.g., roughened, knurled, splined, etc.), or otherwise configured to adjust the friction between the body 102, the lever arms 110, and the button 108. By way of example, the engagement surface 472, the helical engagement surfaces 426, and the helical engagement surfaces 462 are roughened to increase the friction holding the link and lever assembly 470 in place. By way of another, example, the engagement surface 472, the helical engagement surfaces 426, and the helical engagement surfaces 462 may be provided with radially extending splines that interlock with one another, holding the link and lever assembly 470 in place.

Figure 34:
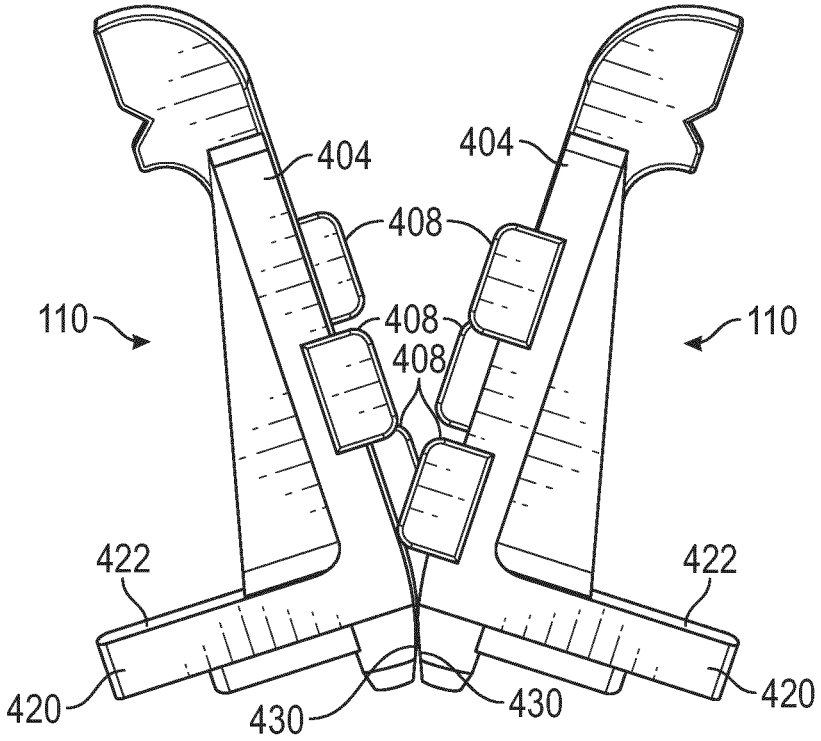
FIG. 34 is a side view of two of the lever arms of FIG. 21.

In operation, the inlet 104 is fluidly coupled to a supply of pressurized fire suppressant fluid. The pressurized fire suppressant fluid is held within the passage 242 by the button 108 and the spring seal 114. The link and lever assembly 470 imparts a longitudinal force on the button 108, holding the button 108 in place. The fusible link 112 holds the lever arms 110 together. If the threshold temperature T is met or exceeded, the solder holding the plates 440 together melts, permitting the lever arms 110 to separate from one another. As shown in FIG. 34, the pressure on the button 108 from the pressurized fire suppressant fluid and the force of the compressed spring seal 114 causes the lever arms 110 to begin rotating apart from one another. At this point, the legs 420 are still captured within the passage 526, but the main bodies 404 can move away from the inlet 104. The curved surfaces 430 engage one another, and the lever arms 110 rotate about the point of engagement between the curved surfaces 430. The curved surfaces 430 ensure that there is some space between the centering posts 428, thereby facilitating rotation of the lever arms 110 relative to one another. If there was no space provided between the curved surfaces 430, there would be less or no space between the centering posts 428, and the lever arms 110 could wedge against one another and not move freely. Eventually, the lever arms 110 rotate to the point where the legs 420 come free from the passage 526. At this point, the force of the pressurized fire suppressant fluid forces the lever arms 110, the button 108, the fusible link 112, and/or the spring seal 114 out of the outlet 260, and the fire suppressant fluid flows freely through the sprinkler 100.

In alternative embodiments, the contours of the helical engagement surfaces 426, the helical engagement surfaces 462, the engagement surface 422, and/or the body 102 are varied. By way of example, the helical engagement surfaces 462 may be replaced with a non-helical engagement surface (e.g., a semicircular surface or other type of surface that is angled relative to the longitudinal axis 106, etc.). While the non-helical engagement surfaces would not contact the entireties of the helical engagement surfaces 426, the helical engagement surfaces 426 could still engage the non-helical engagement surfaces to facilitate adjustment of the lever arms 110 to account for tolerance in longitudinal dimensions. By way of another example, the engagement surface 422 and/or the engagement surface 472 may have corresponding helical curvatures. In such an embodiment, the helical engagement surfaces 426 and the helical engagement surfaces 462 may instead be flat engagement surfaces (e.g., perpendicular to the longitudinal axis 106) while still facilitating adjustment of the lever arms 110 to account for tolerance in longitudinal dimensions.

In other embodiments, one or more of the lever arms 110 and the fusible link 112 are omitted, and the sprinkler 100 includes a different type of activation element or activation assembly. The activation assembly may activate in response to any indication that a fire may be nearby. By way of example, the activation assembly may include a temperature-sensitive frangible bulb that shatters upon reaching a threshold temperature, activating the sprinkler 100. By way of another example, the activation assembly may include a shape memory alloy that changes shape upon reaching a threshold temperature, activating the sprinkler. By way of another example, the activation assembly may include an electric actuator that is configured to activate the sprinkler. The electric actuator may be coupled to a controller that uses an input from a sensor to determine if a threshold temperature has been reached and subsequently activates the electric actuator.

Configuration of Exemplary Embodiments

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A sprinkler, comprising:
a body defining:
a passage having an inlet configured to be fluidly coupled to a source of fire suppressant fluid, the passage extending along a longitudinal axis; and
an outlet fluidly coupled to the passage;
a button positioned along the passage;
a seal engaging the button and the body to fluidly seal the inlet from the outlet; and
a link and lever assembly including:
a first lever and a second lever engaging the button, the first lever and the second lever each including:
a leg positioned near a base end of the lever and extending outward from the longitudinal axis, the leg defining an engagement surface;
a head positioned near a tip end of the lever;
a main body extending along the longitudinal axis from the leg to the head; and
a post extending longitudinally away from the main body, the button defining a recess to receive the post; and
a fusible link limiting movement of the heads away from the longitudinal axis,
the engagement surfaces of the first lever and the second lever each to engage a surface of the body to limit movement of the button along the longitudinal axis.

2. The sprinkler of claim 1, wherein the link and lever assembly is received within a link aperture defined by the body, wherein the link aperture includes an entry section sized to permit passage of the legs therethrough and a holding section sized to prevent passage of the legs therethrough.

3. The sprinkler of claim 2, wherein the link aperture is centered about the longitudinal axis, wherein the entry section has a first radius that is greater than a distance between the longitudinal axis and an end of the leg of the first lever, and wherein the holding section has a second radius that is less than the distance between the longitudinal axis and the end of the leg of the first lever.

4. The sprinkler of claim 1, wherein the fusible link includes a pair of plates coupled to one another, wherein each head defines a notch that receives one of the plates of the fusible link, and wherein the notches face opposite directions.

5. The sprinkler of claim 4, wherein each head includes a curved surface that extends away from the longitudinal axis as the curved surface approaches the tip end of the lever, and wherein each curved surface extends between the corresponding notch and the longitudinal axis.

6. The sprinkler of claim 1, wherein the first lever includes a pair of first alignment tabs coupled to the main body of the first lever and receiving the main body of the second lever therebetween.

7. The sprinkler of claim 6, wherein the second lever includes a pair of second alignment tabs coupled to the main body of the second lever and receiving the main body of the first lever therebetween.

8. The sprinkler of claim 7, wherein the first lever includes at least three first alignment tabs, wherein the second lever includes at least three second alignment tabs, and wherein the first alignment tabs interlock with the second alignment tabs to limit longitudinal movement of the first lever relative to the second lever.

9. The sprinkler of claim 1, wherein the first lever and the second lever are made from a polymeric material.

10. The sprinkler of claim 1, wherein the main bodies each define a flat surface, wherein the posts each define a curved surface, wherein the flat surfaces engage one another, and wherein the curved surfaces are configured to engage one another when the first lever and the second lever separate from one another to release the button from the body.

11. A sprinkler, comprising:
a body defining:
a passage having an inlet configured to be fluidly coupled to a source of fire suppressant fluid, the passage extending along a longitudinal axis;
an outlet fluidly coupled to the passage; and
a body engagement surface;
a button positioned along the passage and defining a button engagement surface;
a seal engaging the button and the body to fluidly seal the inlet from the outlet; and
an activation assembly holding the button against the seal, the activation assembly defining a first engagement surface engaging the button engagement surface and a second engagement surface engaging the body engagement surface,
wherein at least two of the body engagement surface, the button engagement surface, the first engagement surface, or the second engagement surface are flat surfaces extending perpendicular to the longitudinal axis, a rotation of the activation assembly about the longitudinal axis causes a longitudinal movement of at least one of the activation assembly or the button relative to the body.

12. The sprinkler of claim 11, wherein at least one of the body engagement surface, the button engagement surface, the first engagement surface, or the second engagement surface are helical surfaces.

13. The sprinkler of claim 12, wherein at least two of the body engagement surface, the button engagement surface, the first engagement surface, or the second engagement surface are helical surfaces, and wherein at least two of the helical surfaces engage one another.

14. The sprinkler of claim 12, wherein the button engagement surface and the first engagement surface are helical surfaces, and wherein the body engagement surface and the second engagement surface are flat surfaces.

15. The sprinkler of claim 12, wherein the button defines a centering recess centered along the longitudinal axis, and wherein the activation assembly includes a centering post that is received within the centering recess.

16. A method of manufacturing a sprinkler, comprising:
providing a body defining a passage extending along a longitudinal axis between an inlet and an outlet;
forming a link and lever assembly by coupling a pair of levers to one another using a fusible link, each lever comprising a head portion and a curved surface, forming the link and lever assembly includes inserting the head portions of the levers through an aperture defined by the fusible link and rotating the levers toward one another with the curved surfaces engaging one another;
inserting a seal and a button into the passage until the seal engages a seat of the body;
inserting the link and lever assembly into the body until a button engagement surface of the button engages a first engagement surface of the link and lever assembly; and rotating the link and lever assembly about the longitudinal axis until a second engagement surface of the link and lever assembly engages a body engagement surface of the body.

17. The method of claim 16, wherein inserting the link and lever assembly into the body until the button engagement surface of the button engages the first engagement surface of the link and lever assembly includes inserting a centering post of each lever into a centering recess defined by the button.

* * * * *